US005360370A

United States Patent [19]

Woolrich

[11] Patent Number: 5,360,370

[45] Date of Patent: Nov. 1, 1994

[54] COIN MANAGEMENT DEVICES AND METHOD

[76] Inventor: Peter Woolrich, 131 Bloor St. West, Toronto, Canada, M5S 1R1

[21] Appl. No.: 925,102

[22] Filed: Aug. 6, 1992

[51] Int. Cl.[5] ..... G07D 9/06

[52] U.S. Cl. ..... 453/59; 453/60; 453/62

[58] Field of Search ..... 453/58–63; 206/0.81, 0.83, 0.84, 0.82

[56] References Cited

U.S. PATENT DOCUMENTS

| | | | |
|---|---|---|---|
| 518,948 | 5/1894 | Hayden | 206/0.81 |
| 1,025,228 | 5/1912 | Abbott | 453/62 X |
| 1,085,673 | 2/1914 | Doldt | 453/59 X |
| 1,457,261 | 5/1923 | Mathewes | 453/62 X |
| 2,444,804 | 7/1948 | Carruthers | 453/62 X |
| 3,231,074 | 1/1966 | Block | 206/0.84 |
| 4,183,432 | 1/1980 | Lemaire | 206/0.82 |

FOREIGN PATENT DOCUMENTS

| | | | |
|---|---|---|---|
| 204481 | 3/1956 | Australia | 453/59 |
| 1128915 | 9/1956 | France | 453/60 |

*Primary Examiner*—F. J. Bartuska
*Attorney, Agent, or Firm*—Martin Faier

[57] ABSTRACT

Coin management devices having a transparent tubular device for receiving and aligning coins flat surface to flat surface and a tray into which aligned coins are arranged and the accumulated value of such coins ascertained. The tubular device has a tube of a diameter greater than a coin, with a mouth arranged midway its length communicating therewith. The tray has a channel into which aligned coins may be placed and indicia associated with the channel for ascertaining the value of coins accumulated therein. The tray may also have legs for elevating one end. A coin management method is also taught which utilizes the coin management devices, and includes the step of rocking and jiggling the tubular device to align coins into a column of a given denomination. Steps of placing coins of selected value columnarly aligned into the tray channel and arranging them in special bankers rolls by laying an open blank over the coins in the channel and tightly squeezing the ends of the blank over the outside end columnarly arranged coins and lifting the column of coins from the channel, whereupon the blank is closed to form a bankers roll. The method also includes steps of tucking an empty coin sleeve for accommodating a roll of coins of selected value and denomination into one end of the tube and inserting coins of corresponding denomination and value into the opposed tube end and then elevating the tube end containing the coins above the opposed tube end so that the coins slide into the sleeve, whereupon the coin filled sleeve is removed from the tubular device and closed.

23 Claims, 2 Drawing Sheets

FIG. 1
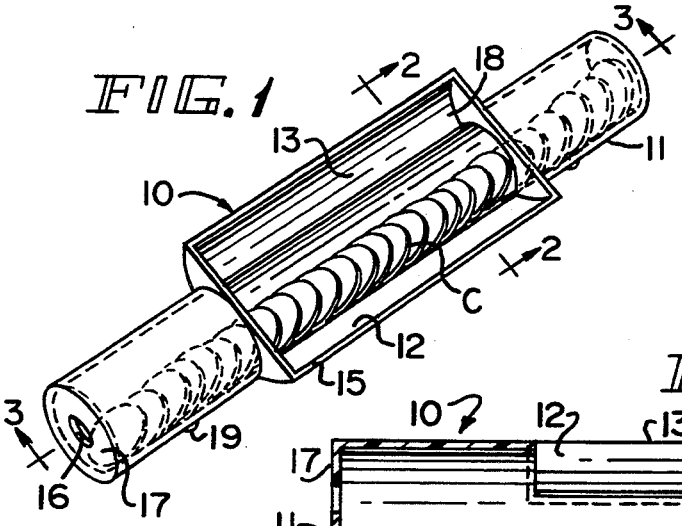
FIG. 2
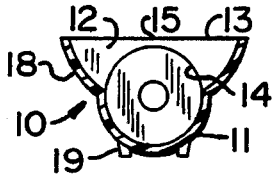
FIG. 3
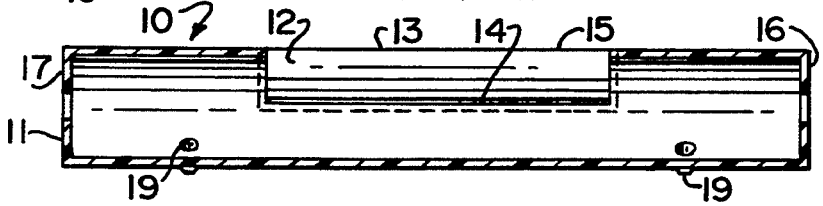
FIG. 4
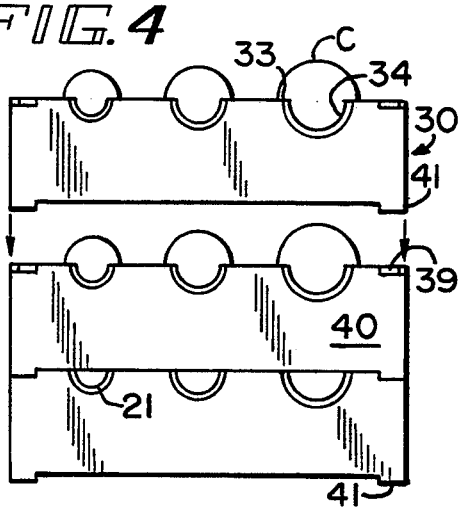
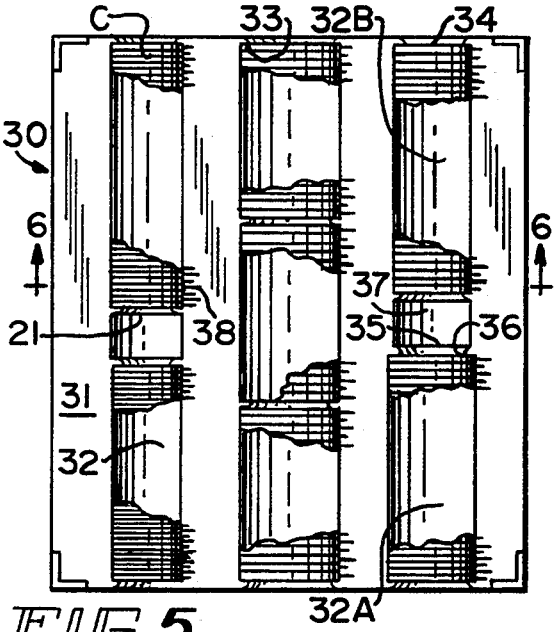
FIG. 6
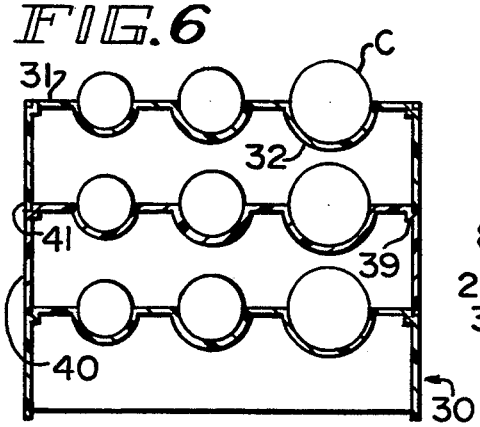
FIG. 5
FIG. 7
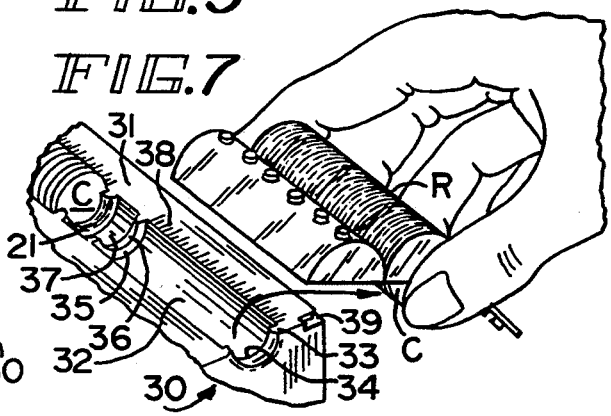

FIG. 11
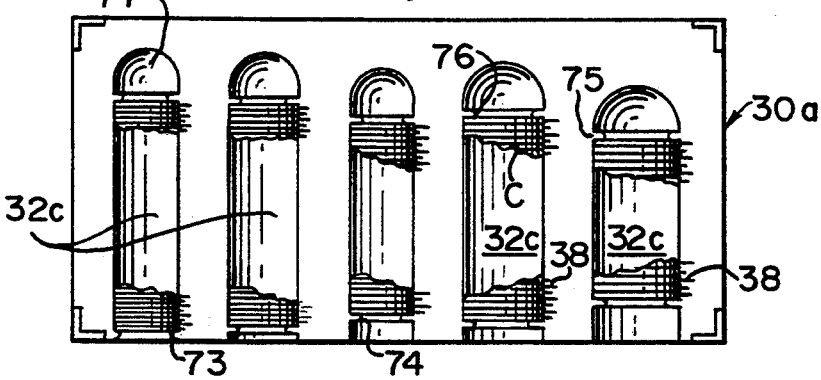
FIG. 8
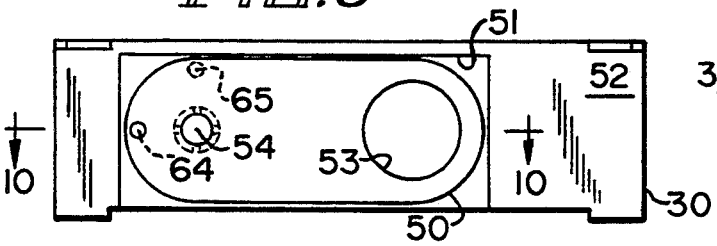
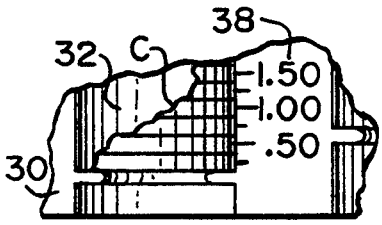
FIG 12
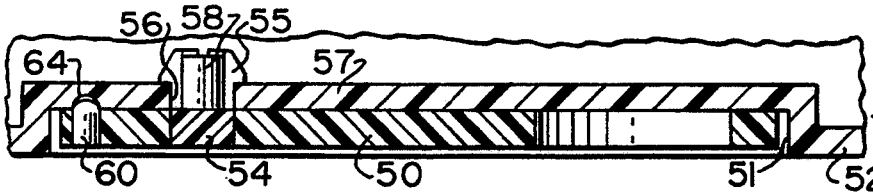
FIG 10
FIG 13
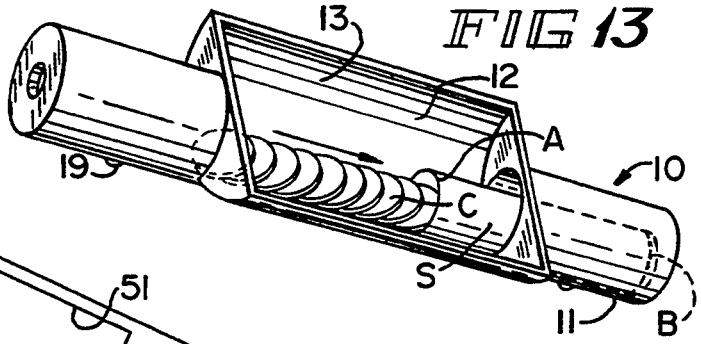
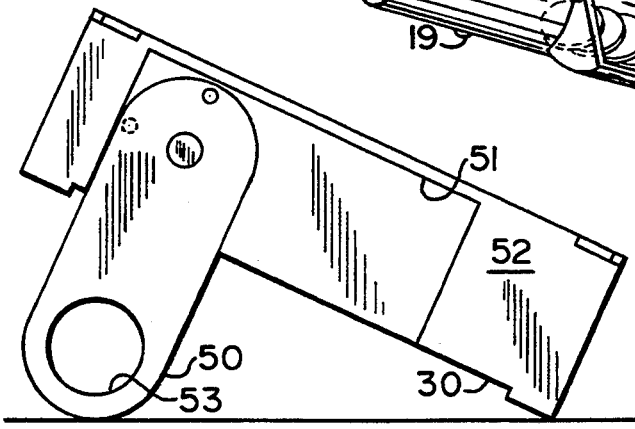
FIG 9

COIN MANAGEMENT DEVICES AND METHOD

BACKGROUND AND SUMMARY OF THE INVENTION

This invention relates to coin management devices and is more particularly concerned with such devices which include a tubular device for receiving and aligning the coins flat surface to flat surface and a tray device into which the aligned coins are arranged to ascertain their accumulated value, preparatory to rolling or storage. The invention is also concerned with a method for managing coins utilizing the devices embodying the invention.

Many complex mechanical, electrical, electronic, electromechanical and other kinds of devices have been conceived to handle, count and store coins. Such devices are usually expensive, require special knowledge or take up excessive space. The present device and method is intended primarily for relatively small business operations where the entrepreneur doesn't have the time, interest or investment necessary to acquire complicated and sophisticated equipment, but is most interested in an easy and efficient system for arranging, totaling the accumulated values and storing coins. The invention deals with a system for handling coins which have already been segregated by denomination in a cash register drawer or the like, which has separate compartments for each coin denomination.

The present invention utilizes an elongated transparent tubular device of a diameter larger than the coins intended to be handled which has a dumping mouth midway its length for receiving and removing coins of the specific denomination. One end of this mouth communicates with the tubular device along its longitudinal axis and the other end of the mouth is open and flared outwardly. This tubular device is designed to permit a handful of coins of predetermined denomination to be hand-scooped up from a compartment in a cash register drawer and to be randomly dumped into the mouth and enter the tubular device, whereupon the tube is manipulated by rocking and jiggling action to align the coins which entered the mouth and tubular device in a random and jumbled fashion to be arranged in line flat surface to flat surface in the tubular device.

Once the coins are aligned, they are removed from the tube upon grasping a number of aligned coins at their opposed flat surfaces through the open mouth and placing these coins in a special tray. This tray has a plurality of channels, and these channels are each sized to receive a predetermined number of coins of a given denomination. For example, there may be a channel which will accommodate forty quarters, which is the size of a $10 bankers roll of such coins. The tray may bear a series of indicia adjacent the channel to indicate the value of coins accumulated in the channel, making the totaling of the value of the accumulated coins very simple and quick. There may be similar channels for coins of usual denominations, such as separate channels for nickels, dimes, quarters, halves and pennies, each of a diameter preferably just slightly larger than the size of the selected coin, and each having accumulator indicia arranged adjacent the channel.

A novel device embodying the invention may also have opposed legs which may be used to elevate one end of the tray, permitting the coins to be gravity biased toward the lower end of the tray, thus making it easier to ascertain the accumulated value of the coins, but with an elevation which is not so high as to allow coins to fall from the channels. Also, the channels may be oriented in parallel groups or in parallel and series.

Preferably, opposed ends along the axis of each of the coin receiving channels have a space which is intended for entry of the thumb and forefinger or middle finger of the user to grasp aligned coins arranged in the channel under pressure at their opposed ends. A bankers coin roll blank of suitable size, such as the device disclosed in U.S. Pat. No. 4,183,432, in open condition, may be laid over the aligned coins in the tray channel, and its ends overlaying the roll may be squeezed together from a point at about the centerline of the aligned coins, and the coins in the blank wrapper are lifted from the tray, whereupon the roll is closed and locked in the manner described in Pat. No. 4,183,432.

The coins in the tray may also be rolled in other conventional fashion too, using flat wrapper which may be formed into bankers rolls. Coins may also be packaged in paper coin shells, utilizing the tubular device embodying the present invention in a manner hereafter described.

In some situations, it is desirable to leave the sorted and counted coins stored in the channels of the tray. For example, in an arcade, restaurant or retail store operation, or where there are multiple cashiers, requiring a volume of coins for making change or other purposes, frequently the coins are sorted and counted and removed to a safe place, usually at the end of the day, and replaced for use the next business day. In these situations, a number of trays with like coin sorting and accumulating channels may be used, and these trays may each have interlocking means to permit the trays to be stacked for easy handling and moving from place to place, for example, from a cashier's station to a safe and then returned to the cashier.

OBJECTS AND ADVANTAGES OF THE INVENTION

It is the object and an advantage of the present invention to provide novel coin management devices of the character referred to.

Another object is to provide a novel coin aligning tube for a coin management system.

Another object is to provide a coin aligning tube of predetermined diameter which has a novel flared coin receiving mouth arranged midway its length.

Another object is to provide a coin aligning tube which has means for manipulating and removing from it multiples of coins which have been arranged flat surface to flat surface.

Another object is to provide a coin aligning tube which may be used for filling paper coin tubes.

Another object is to provide a novel tray for receiving multiples of coins of a predetermined denomination which have been arranged flat surface to flat surface.

Another object is to provide a coin receiving tray having channel means which includes indicia for ascertaining the value of predetermined coins arranged therein.

Another object is to provide a coin receiving tray which has means for holding aligned coins of a given denomination and accumulated value which may be subsequently easily arranged in bankers rolls.

Another object is to provide a coin receiving tray which has support means for selectively tilting the tray to arrange one end of a coin receiving channel at an elevation higher than its other end.

Another object is to provide a plurality of coin receiving trays which may be interlocked for easy stacking, transport and storage.

Another object is to provide a method for managing coins by dumping random numbers of coins of a predetermined denomination into a tubular device and manipulating the tube to arrange such coins flat surface to flat surface, removing the arranged coins from the tubular device and placing them in a coin receiving channel of a tray having indicia for ascertaining the value of such coins up to a predetermined number of coins.

Another object is to provide such a method with the additional step of removing the coins from channels when the predetermined number of coins have been accumulated by pressing the opposed faces of the aligned coins together, lifting them from the tray channel, and installing such coins into a coin wrapper.

Another object is to provide such a method with the additional step of arranging a plurality of such trays in stacked and interlocked fashion.

All of the foregoing objects offer advantages and utility for the present invention, and it is also an object and advantage of the invention to provide coin management devices which are easy and relatively inexpensive to manufacture and simple and efficient in use, as well to provide a method for managing coins which is easy and efficient to practice.

These and other objects and advantages of the invention will become more apparent as this description proceeds, taken in conjunction with the accompanying drawings.

BRIEF DESCRIPTION OF THE DRAWINGS

In the drawings:

FIG. 1 is a perspective view showing the novel tubular device with its flared mouth embodying the invention.

FIG. 2 is a cross-section view of the tubular device taken on line 2—2 of FIG. 1.

FIG. 3 is a cross-sectional view of the tubular device taken on line 3—3 of FIG. 1.

FIG. 4 is a side elevational view of stacked coin filled trays embodying the invention.

FIG. 5 is a top plan view of the upper one of the stacked coin filled trays embodying the invention.

FIG. 6 is a cross-section view of the trays taken on line 6—6 of FIG. 5.

FIG. 7 is a perspective view illustrating the removal of a roll of aligned coins from the tray and their installation into a bankers roll.

FIG. 8 is a side elevational view of a coin tray device embodying the invention showing a pivotally movable leg for tilting the tray in closed position.

FIG. 9 is a side elevational view of the FIG. 8 coin tray device shown in FIG. 8, shown in open position.

FIG. 10 is an enlarged partial sectional view of the leg and tray device, taken on line 10—10 of FIG. 8.

FIG. 11 is a top plan view of a modified coin tray device.

FIG. 12 is an enlarged fragmentary plan view of the counting indicia and coin channel of a coin tray device.

FIG. 13 is a perspective view of a tubular device embodying the present invention used for filling a closed-end paper coin sleeve.

DESCRIPTION OF PREFERRED EMBODIMENTS

Tube and Tray Devices

With reference to the accompanying drawings, the coin management devices which are the subject of this invention essentially consist of a novel tubular device 10 and a novel tray device 30.

The tubular device 10, shown in FIGS. 1–3, preferably fabricated from transparent plastic, comprises an elongated tube 11, having a diameter larger than a coin C to be handled, which has arranged midway its length a coin dumping mouth 12. Preferably, the coin dumping mouth 12 has an opening 13 which is substantially wider than the diameter of the tube 11 and the mouth may be of a size about half the length of the tube. The bottom of the mouth 12 has a throat 14 open to the tube 11 at a point about at the major diameter of the tube. Preferably the tube 11 also has apertures 16 at its opposed ends 17, and the side walls 18 of the mouth 12 are preferably curved. Preferably arranged along the longitudinal axis of the tube 11 are spaced apart legs 19 to maintain the tubular device 10 is upright position when placed on a flat surface.

The tray device 30, shown in FIGS. 4–7, also preferably fabricated from plastic, has a top surface 31 into which one or more channels 32 are formed. Each channel 32 has a diameter suitable for accommodating a coin of a selected denomination, e.g. there may be separate channels for pennies, dimes, nickels, quarters and half dollars, respectively.

Each channel 32 is defined by an outside wall 33 having an opening 34 of reduced diameter at one longitudinal end and an inside wall 35 also having an opening 36 of reduced diameter at it opposed longitudinal end. Longitudinally arranged channels 32A and 32B preferably may have an enlarged space 37 between them. Value indicia 38 (preferably parallel lines and numbers) are arranged along one side of each of the channels 32. The outside edges 21 of the walls 33 and 35 are preferably rounded or chamfered. A comfortable space is provided so a finger or thumb can enter the tray at the outside end of the channel. The outside edges of the channels are rounded so that when the pads of the thumb or finger are squeezed against the outside coins, the edge does not hurt the digits, while exerting maximum pressure against the outside coins.

Preferably, the corners 39 of the top surface 31 of each tray device 30 are notched, and the tray devices each have side walls 40 of sufficient height to permit the feet 41 of each tray device 30 to nest into the notched corner 40 of a tray device 30 upon which it is stacked, without interfering with coins C arranged in the channels 32, as shown in FIG. 4. Where a wrapper like the bankers roll disclosed in U.S. Pat. No. 4,183,432 is used, coins C may be removed from a filled channel 32 by use of a bankers roll R in the manner shown in FIG. 7, or by other means, as hereinafter described.

The tray device 30 may have means for tilting it in a selected position, as shown in FIGS. 8–10, by providing a support 50 which may be pivotally secured in a recess 51 formed in opposed longitudinal sides 52 of the tray device 30, preferably on opposed sides parallel with the coin channels 32. This support 50 at its one end has a finger hole 53 and at its other end has a stud 54, force fit through the support 50, having a segmented barbed shaft 55 extending inwardly through a corresponding aperture 56 formed in the wall 57 of said recess 51, which is pivotally secured to the recess wall 57 by means of a plug 58 force locked into the end of the segmented barbed shaft 55. The support 50 may have a detente 60 formed on and protruding from its inner surface radially disposed thereon in a direction at its end opposed to the finger hole 53, and this detente is adapted to seat in one of two depressions 64 or 65 radially disposed angularly to one another, formed in the recess wall 57 around the stud 54.

By tilting the tray device 30 and the coin channels 32, the eye of the user looking at the tray on an angle may easily see the last coin C in the channel 32 aligned with the value indices 38 on the side of the coins. Further, this tilting arrangement shown in FIG. 9 prevents the last coin C in the channel 32 or 32*c* from toppling forward, as it may do if the tray device were disposed on a level surface. When the support 50 is folded into the recess 51, as shown in FIG. 8, a plurality of trays 50 may be stacked, shown in FIG. 4.

As shown in FIG. 11, the coin channels 32*c* of the tray device 30*a* may also be arranged in parallel, each channel parallel longitudinally to the next channel, with each channel accommodating coins of a different denomination. In this embodiment, there are multiple channels 32*c*, i.e. one for pennies, nickels, dimes, quarters, and dollars, respectively, arranged parallel to one another. Each channel 32*c* has an outside wall 73 having an opening 74 of reduced diameter at one longitudinal end and an inside wall 75 also having an opening 76 of reduced diameter at its opposed longitudinal end. Adjacent each opening 76 there may be a semicircular space 77 and there may be an enlarged area adjacent each opening 74, both for entry of the thumb and a finger of the user to squeeze toward one another the outside coins arranged in the channel 32*c*. Value indicia 38 (preferably parallel lines and numbers) may be arranged along one side of each of the channels 32*c*. The outside edges of the walls 73 and 75 are each rounded and chamfered to permit the fingers of the user to press toward one another for holding the coins in the channel at about their center line, necessary for convenient lifting and removal of coins from the channels for rolling, as hereinafter described.

Coin Management Method

In use, a bunch of coins C of one denomination may be lifted from a cash drawer compartment and randomly dumped into the opening 13 of the mouth 12 of a tubular device 10 embodying this invention. The coins C are made to run up and down the tube 11 by manipulating the tubular device in a rocking and jiggling fashion a few time until the coins line up as shown in FIG. 1. If coins become jammed in the tube, a pencil or similar shaft-like device may be inserted into the tube end hole 16 to release the jam.

After the coins C have been aligned, a user may reach into the tube mounth 12, preferably with the third finger and thumb and lift out a comfortable number of coins, which are placed into the appropriate channel 32 of the tray device 30 for coins of the selected denomination. The value of coins C placed in the tray channel 32 may be ascertained by a quick viewing of the indicia 38 adjacent the channel 32 selected. When the channel 32 is filled, a transparent plastic bankers roll wrapper R, like the one disclosed in U.S. Pat. No. 4,183,432, of a selected denomination like the denomination of the coins accumulated in the channel 32, is spread open and the center section of the wrapper is placed over the coin filled section of the channel 32.

The longitudinal ends E of the filled wrapper R are pressed together at about the center line of the coins C and lifted out of the tray, whereupon the wrapper is closed and locked according to the means shown in U.S. Pat. No. 4,183,432.

When using the support 50 shown in FIGS. 8–10, the finger hole 53 is grasped and the support is pivoted downwardly away from the tray side 52 on the stud 54 about 90 degrees from its storage or closed position nested in the recess 51 shown in FIG. 8. When the support 50 is in storage or open position, shown in FIG. 8, or in supporting position pivoted out of the recess, shown in FIG. 9, it is locked into position by means of the detente 60 and selected depression 64 or 65 previously described. With the support 50 down, to thus elevate one end of the tray and its channel, coins C will bear against the lowermost edge of the tray channel, making the value of accumulated coins easier to ascertain.

Preferably, the tube 11 of the tubular device 10 is about twice the length of the mouth 12, so that the coins C may be quickly aligned while still having a mouth 12 of sufficient size to admit the fingers of the user. It has been noted that a tube 11 of greater length will provide a more rapid means for easily aligning the coins C, but if the tube is too long, the size become inconvenient. Preferably, the mouth 12 is at about the center of the tube 11 because if the mouth 12 is not at about that position the coins are more likely to "jump" out of the tube when the tube is manipulated.

Bankers rolls R other than those of a kind shown in U.S. Pat. No. 4,183,432 may be used, except in that case, once the coins C of a correct number are accumulated in a channel 32, the coins may be removed by squeezing their longitudinal ends without the benefit of the wrapper, holding them tightly squeezed together, lifted from the tray, and then placed onto the wrapper for rolling in a conventional way. Also, the tray device may be used just as a means for ascertaining the value of accumulated coins, and the roll may be made by rolling the coins in other convenient conventional fashion, too.

In many situations coins are not rolled, for example, where the coins are placed in a safe over night and returned to a cashier for use the next day. In such a circumstance, coins C are usually accumulated and their total values noted and possibly recorded, and then filled trays are stacked. By the use of the present invention, the value of the accumulated coins may be quickly and conveniently observed, and the coins may be transported to a safe place and returned for use at the appointed time.

The tubular device 10 may also be used with conventional coin sleeves, like the sleeve S shown in FIG. 13, which has an open end A and a rolled stiffened end B. Such sleeves are intended for a specific denomination and number of coins in a bankers roll, and the coins arranged in the tray channel selected coincide with the denomination and number necessary to fill the sleeve. In this embodiment of the method, the rolled end B of the sleeve S is inserted into the end of the tube 11 and the open end A of the sleeve S is arranged in the tube just below the throat 14 of the mouth 12. Normally, an entire filled channel of coins, containing the exact amount in a bankers roll of one denomination, is carefully lifted from the counting tray in the manner described, and slipped Into one end of the empty tube 11, then the sleeve S is tucked into the other end of the tube, stiffened rolled end B first. Now the tube is tipped so that the end holding the sleeve S is lower than the end holding the coins. The coins slide downwardly under gravity into the sleeve S. The filled sleeve is removed from the opening 13 of the mouth 12, and the open end A of the sleeve S is closed.

While preferred embodiments of the invention have been shown and described in considerable detail, it should be noted that this description is not intended to limit the invention, as may variations in details can be made without departing from the scope or spirit of the invention. Accordingly it is not intended that the invention should be limited to the structure and method disclosed, except as limited by the appended claims.

I claim:

1. In a tubular device for receiving and aligning coins of a predetermined size and denomination flat surface to flat surface, said device comprising:

an elongated transparent tube of a diameter at least as large as the diameter of said coins, and a mouth communicating with said tube into which said coins may be dumped, said mouth having an entry opening greater than the diameter of said tube and communicating with said tube midway its length, said device being manipulatable from end to end and adapted to arrange coins therein in flat surface to flat surface alignment when rocked and jiggled.

2. In the devices recited in claim 1, wherein said mouth has an entry opening greater than the diameter of said tube.

3. In the devices recited in claim 2, wherein said mouth communicates with said tube midway its length.

4. In the devices recited in claim 2, wherein said mouth has side walls which are curved from its opening to said tube.

5. In the device recited in claim 4, wherein said tube is of substantially greater length in an axial direction than said mouth.

6. In the devices recited in claim 1, wherein said tube has opposed parallel ends remote from one another.

7. In the devices recited in claim 6, wherein each of said opposed parallel ends has a central aperture of a diameter less than the diameter of said coins.

8. In the devices recited in claim 1, wherein said tubular device has spaced apart legs.

9. In the devices recited in claim 1, wherein said tube is manipulatable from end to end and adapted to arrange coins therein in flat surface to flat surface alignment when rocked and jiggled.

10. In the tubular device recited in claim 1, in which said mouth has side walls which are curved from its opening to said tube.

11. In the tubular device recited in claim 1, in which said tube has opposed parallel ends each having an aperture less than the diameter of said coins.

12. In the tubular device recited in claim 1, wherein said device has legs extending from said tube for stabilizing said device on a flat surface.

13. In the tubular device recited in claim 1, wherein said tube is substantially longer than said mouth.

14. In the tubular device recited in claim 1, wherein said tube contains a sleeve for receiving coins of a predetermined size and denomination, and the tube has a length less than the length of said sleeve.

15. In the tubular device recited in claim 1, wherein said tube has a sleeve which is of a length longer than the length of said tube.

16. A method for managing coins comprising the steps of dumping a plurality of coins of the same size and denomination into the mouth of a tubular coin receiving device, manipulating the tubular coin receiving device by rocking and jiggling action until the coins are columnarly aligned flat surface to flat surface, reaching into and lifting from the mouth of said coin receiving device aligned coins and installing said coins into a channel of predetermined length in a coin tray;

observing the value of said coins in said channel by observing value indicia associated with said channel, placing a formed coin wrapper over said filled tray channel, squeezing the ends of said assembled wrapper over the outside ends of said columnarly aligned coins, lifting said assembly from said channel, and closing said coin wrapper to form a bankers roll.

17. A method for managing coins comprising the steps of dumping a plurality of coins of the same size and denomination into the mouth of a coin receiving device having coin receiving tubular means in communication with opposed sides of said mouth, Manipulating the coin receiving device by rocking and jiggling action until the coins are aligned flat surface to flat surface and arranged in a column in said tubular means, reaching into and lifting from the mouth of said coin receiving device said column of aligned and arranged coins and installing said column of coins into a channel of predetermined length in a coin tray; and observing the value of said coins in said channel by observing value indicia associated with said channel.

18. In the method for managing coins recited in claim 17, with the additional step of elevating one end of said coin tray so that the coins by gravity bear against one end of said channel.

19. In the method recited in claim 17, wherein said channel is of a length corresponding to the number of coins required to make up a bankers roll, and said channel is filled until said number of coins required to make up said bankers roll is accumulated.

20. A method for managing coins comprising the steps of placing a predetermined number of coins of the same size and denomination aligned flat surface to flat surface into one end of a tubular coin receiving device through a mouth arranged in said device and placing an empty coin sleeve adapted to receive said predetermined number of coins of said size and denomination into another end of said tubular coin receiving device, and tipping said device so that the end containing the coins is elevated relative to the end containing said sleeve and the coins passing past said mouth are moved into and fill said sleeve.

21. A method of managing coins comprising the steps of arranging in a tubular coin receiving device having a mouth a coin wrapper open at one end and closed at another end adapted to receive therein coins of the same size and denomination, dumping a plurality of coins of the said size and denomination into the mouth of said tubular coin receiving device, manipulating the tubular coin receiving device by rocking and jiggling action until the coins pass past said mouth and are columnarly aligned flat surface to flat surface against said closed end in said wrapper through its said open end, removing said wrapper containing said aligned coins arranged therein from said coin receiving device; and closing the open end of said coin wrapper.

22. A method for assembling a bankers roll of coins having a predetermined selected denomination and number of coins, said method comprising the steps of dumping a plurality of the selected coins into a coin receiving device, manipulating the coin receiving device to align the coins flat surface to flat surface arranged in a column, removing aligned columnarly arranged coins from the coin receiving device and placing said column of coins into a tray channel defining a column having end abutments spaced apart a length substantially corresponding to said bankers roll until the number of coins required for said bankers roll has been satisfied accumulated between said abutments and said tray channel is full, arranging a bankers roll shell over the coins in said filled tray channel, and removing said shell and coins from said channel by pressing the faces of said column together through said shell adjacent said abutments.

23. In the method recited in claim 22, wherein the step of forming said bankers roll comprises placing an open bankers roll shell over said coins in said filled channel, removing said assembled shell and coins from said channel, and closing said bankers roll shell.

* * * * *